US011111928B2

(12) United States Patent
Tomaru

(10) Patent No.: US 11,111,928 B2
(45) Date of Patent: Sep. 7, 2021

(54) INDUCER AND PUMP

(71) Applicant: IHI Corporation, Koto-ku (JP)

(72) Inventor: Hiroshi Tomaru, Tokyo (JP)

(73) Assignee: IHI Corporation, Koto-ku (JP)

( * ) Notice: Subject to any disclaimer, the term of this patent is extended or adjusted under 35 U.S.C. 154(b) by 471 days.

(21) Appl. No.: 15/874,957

(22) Filed: Jan. 19, 2018

(65) Prior Publication Data

US 2018/0142695 A1 May 24, 2018

Related U.S. Application Data

(63) Continuation of application No. PCT/JP2016/053040, filed on Feb. 2, 2016.

(30) Foreign Application Priority Data

Sep. 14, 2015 (JP) ..... JP2015-180708

(51) Int. Cl.
*F04D 29/18* (2006.01)
*F04D 3/02* (2006.01)
(Continued)

(52) U.S. Cl.
CPC ..... *F04D 29/181* (2013.01); *F04D 1/025* (2013.01); *F04D 3/02* (2013.01); *F04D 7/00* (2013.01);
(Continued)

(58) Field of Classification Search
CPC ..... F04D 29/181; F04D 1/025; F04D 3/02; F04D 7/00; F05D 2250/292; F05D 2240/303; F05D 2250/73
See application file for complete search history.

(56) References Cited

U.S. PATENT DOCUMENTS 3,442,220 A * 5/1969 Mottram ..... F04D 15/0022 415/218.1
3,951,565 A 4/1976 Rothe et al.
(Continued)

FOREIGN PATENT DOCUMENTS

CN 1954151 A 4/2007
CN 102465912 A 5/2012
(Continued)

OTHER PUBLICATIONS

International Search Report dated May 17, 2016 in PCT/JP2016/053040 filed Feb. 2, 2016 (with English Translation).
(Continued)

*Primary Examiner* — Kenneth Bomberg
*Assistant Examiner* — Adam W Brown
(74) *Attorney, Agent, or Firm* — Oblon, McClelland, Maier & Neustadt, L.L.P.

(57) ABSTRACT

An inducer includes a hub and a blade which radially protrudes from the hub and is helically provided. The inducer has a thick portion in which a first distance and a second distance coincides with each other in a region outside a position at which a height ratio of the blade is 0.5 while the first distance is shorter than the second distance in a region inside the position at which the height ratio of the blade is 0.5, in which the height ratio is a ratio of a distance from a connection portion between the hub and a root portion of the blade with respect to a height of the blade which is a distance from the connection portion between the hub and the root portion of the blade to a tip portion of the blade in the radial direction of the blade.

12 Claims, 10 Drawing Sheets

(51) Int. Cl.
*F04D 1/02* (2006.01)
*F04D 7/00* (2006.01)

(52) U.S. Cl.
CPC .. *F05D 2240/303* (2013.01); *F05D 2250/292* (2013.01); *F05D 2250/73* (2013.01)

(56) References Cited

U.S. PATENT DOCUMENTS

| | | | | | |
|---|---|---|---|---|---|
| 4,365,932 | A | * | 12/1982 | Arnaudeau | F04D 31/00 415/199.5 |
| 4,789,306 | A | * | 12/1988 | Vorus | B63H 1/26 416/223 R |
| 5,114,313 | A | * | 5/1992 | Vorus | B63H 20/245 416/243 |
| 5,139,391 | A | * | 8/1992 | Carrouset | B63H 1/14 415/143 |
| 6,435,829 | B1 | | 8/2002 | Meng et al. | |
| 2006/0110245 | A1 | | 5/2006 | Ashihara et al. | |
| 2007/0160461 | A1 | | 7/2007 | Lee | |
| 2012/0121421 | A1 | | 5/2012 | Wait et al. | |
| 2015/0010394 | A1 | | 1/2015 | Watanabe | |

FOREIGN PATENT DOCUMENTS

| | | | |
|---|---|---|---|
| CN | 102678617 | A | 9/2012 |
| CN | 104500438 | A | 4/2015 |
| JP | 58-005500 | | 1/1983 |
| JP | 02-033499 | | 2/1990 |
| JP | 06-307396 | | 11/1994 |
| JP | 10-227295 | | 8/1998 |
| JP | 2000-110783 | | 4/2000 |
| JP | 2002-070793 | | 3/2002 |
| JP | 2004-132210 | | 4/2004 |
| JP | 2008-190390 | | 8/2008 |
| JP | 4436248 | | 3/2010 |
| WO | 2013/108832 | | 7/2013 |

OTHER PUBLICATIONS

Written Opinion dated May 17, 2016 in PCT/JP2016/053040 filed Feb. 2, 2016.

* cited by examiner

INDUCER AND PUMP

CROSS-REFERENCE TO RELATED APPLICATION

This application is a continuation application based on PCT Patent Application No. PCT/JP2016/053040, filed on Feb. 2, 2016, whose priority is claimed on Japanese Patent Application No. 2015-180708, filed on Sep. 14, 2015. The contents of both the PCT Patent Application and the Japanese Patent Applications are incorporated herein by reference.

TECHNICAL FIELD

The present disclosure relates to an inducer and a pump.

BACKGROUND ART

A rocket engine or the like includes a pump which pressurizes a cryogenic fluid such as liquid hydrogen or liquid oxygen. An inducer is provided in the pump in order to maintain suction performance. The inducer includes a hub which is connected to a rotary shaft and a blade which radially protrudes from the hub and is helically provided, and the inducer is disposed on a suction port of the pump and pressurizes a cryogenic fluid to prevent occurrence of cavitation (for example, refer to Patent Documents 1 and 2 below).

CITATION LIST

Patent Document

[Patent Document 1] Japanese Unexamined Patent Application, First Publication No. H2-33499

[Patent Document 2] PCT International Publication No. WO2013/108832

SUMMARY

Technical Problem

On the other hand, in the inducer, in order to increase cavitation performance, generally, a wedge surface which is inclined toward a leading edge is provided on a negative-pressure surface side of a blade, and a front edge is formed in a wedge shape (tapered shape).

In the inducer, if a blade thickness of a root portion of the blade connected to a hub increases in order to increase bending strength of the blade, an angle of the wedge surface increases according to this. If the angle of the wedge surface increases, the cavitation performance decreases, the blade thickness increases, and a flow path width between blades is narrowed. Accordingly, clogging caused by the cavitation is accelerated and suction performance decreases.

The present disclosure is made in consideration of the above-described problems, and an object thereof is to provide an inducer and a pump capable of increasing bending strength of a blade in a state where suction performance is maintained by thickening a root portion of the blade without increasing an angle of a wedge surface.

Solution to Problem

The inventor of the present disclosure has conducted extensive and intensive experiments in order to solve the above-described problems. As a result, the present inventor has found that it is possible to increase bending strength of a blade in a state where suction performance is maintained by changing a shape of the blade on a positive-pressure surface side without changing a shape of the blade on a negative-pressure surface side on which a wedge surface is provided and has arrived at the invention of the present disclosure.

That is, in order to solve the above-described problems, according to a first aspect of the present disclosure, there is provided a inducer including: a hub; a blade which radially protrudes from the hub and is helically provided; a wedge surface which is provided on a negative-pressure surface side of the blade so as to be inclined toward a leading edge; and a thick portion in which a first distance and a second distance coincides with each other in a region outside a position at which a height ratio of the blade is 0.5 while the first distance is shorter than the second distance in a region inside the position at which the height ratio of the blade is 0.5, in which the height ratio of the blade is a ratio of a distance from a connection portion between the hub and a root portion of the blade with respect to a height of the blade which is a distance from the connection portion between the hub and the root portion of the blade to a tip portion of the blade in the radial direction of the blade.

According to the present disclosure, it is possible to provide an inducer and a pump capable of increasing bending strength of the blade by increasing a blade thickness in the root portion of the blade in a state where cavitation performance is maintained.

DESCRIPTION OF EMBODIMENTS

Hereinafter, embodiments of an inducer according to the present disclosure will be described with reference to the drawings.

Figure 1:
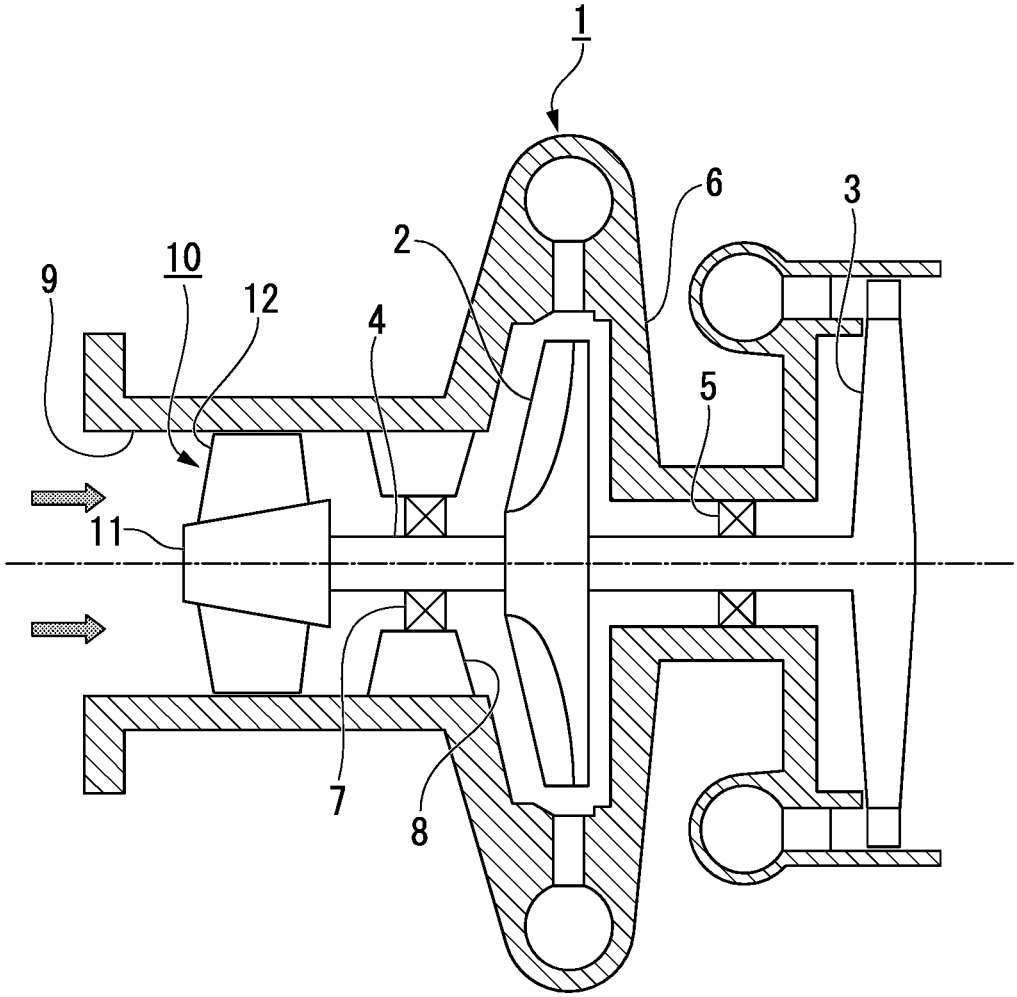
FIG. 1 is a configuration view of a pump having an inducer in an embodiment of the present disclosure.

FIG. 1 is a configuration view of a pump 1 having an inducer 10 in an embodiment of the present disclosure.

The pump 1 of the present embodiment is a turbo pump which pressurizes a cryogenic fluid such as liquid hydrogen or liquid oxygen and includes a centrifugal impeller 2, a turbine 3, and the inducer 10. The centrifugal impeller 2, the turbine 3, and the inducer 10 are connected to each other coaxially with respect to a rotary shaft 4.

The rotary shaft 4 is rotatably supported by a pump casing 6 via a bearing 5 between the centrifugal impeller 2 and the turbine 3. In addition, the rotary shaft 4 is rotatably supported by the pump casing 6 via a bearing 7 between the inducer 10 and the centrifugal impeller 2. In addition, a reference numeral 8 indicates a stationary blade for introducing a fluid of which a pressure is increased by the inducer 10 into the centrifugal impeller 2.

The inducer 10 maintains suction performance of the pump 1. The inducer 10 is disposed in a pump suction port 9 on an upstream side of the centrifugal impeller 2, pressurizes a fluid, and assists suction of the centrifugal impeller 2. The inducer 10 includes a hub 11 which is connected to the rotary shaft 4 and a blade 12 which radially protrudes from the hub 11. A tank (not shown) in which a fluid is accommodated is connected to the pump suction port 9.

In the pump 1 configured as described above, if the turbine 3 is rotated by the action of a high-temperature and high-pressure gas, the centrifugal impeller 2 which is coaxial with the turbine 3 rotates, and the inducer 10 rotates. A fluid is introduced from the tank (not shown) to the pump suction port 9 by the rotation. The pump 1 pressurizes the fluid from the tank by the inducer 10, causes the fluid to flow to the centrifugal impeller 2 side, and further pressurizes the fluid by the rotation of the centrifugal impeller 2 so as to discharge the fluid.

Figure 2:
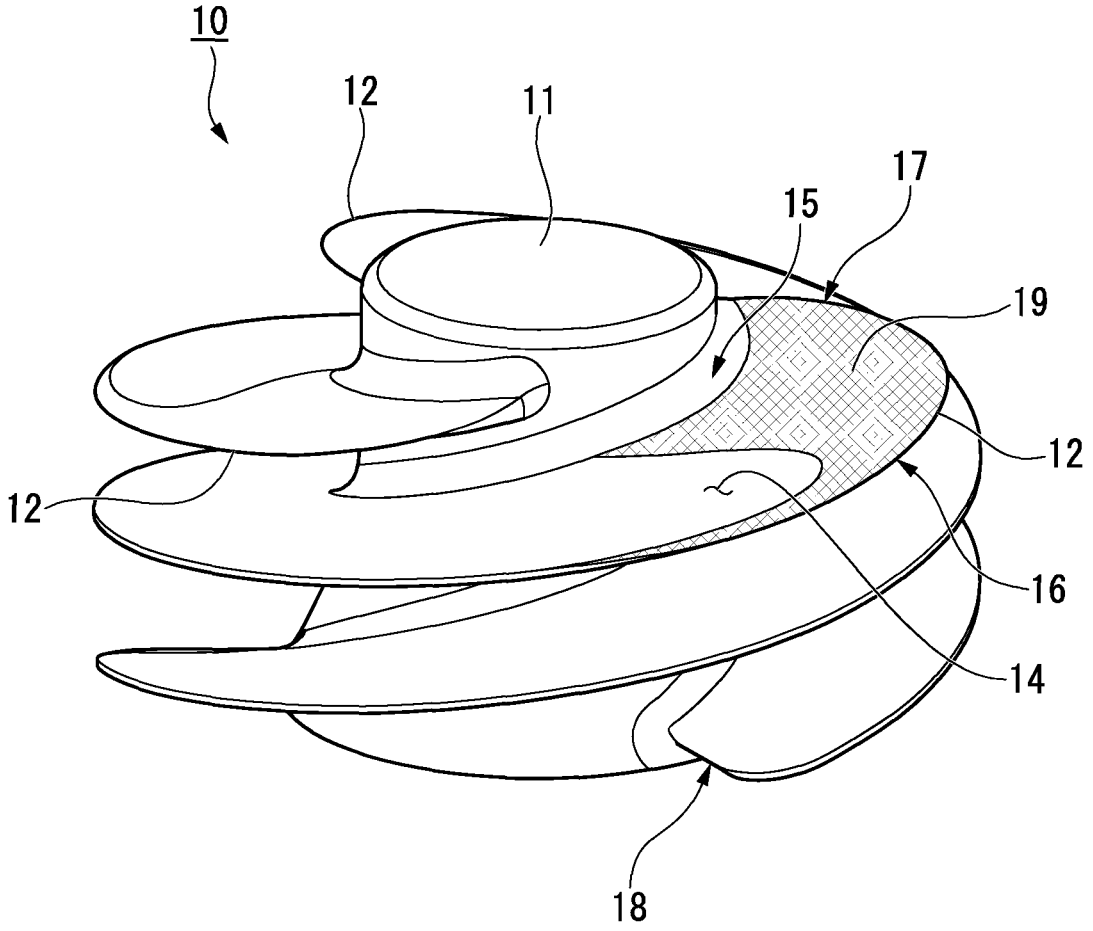
FIG. 2 is a perspective view of the inducer in the embodiment of the present disclosure.
Figure 3:
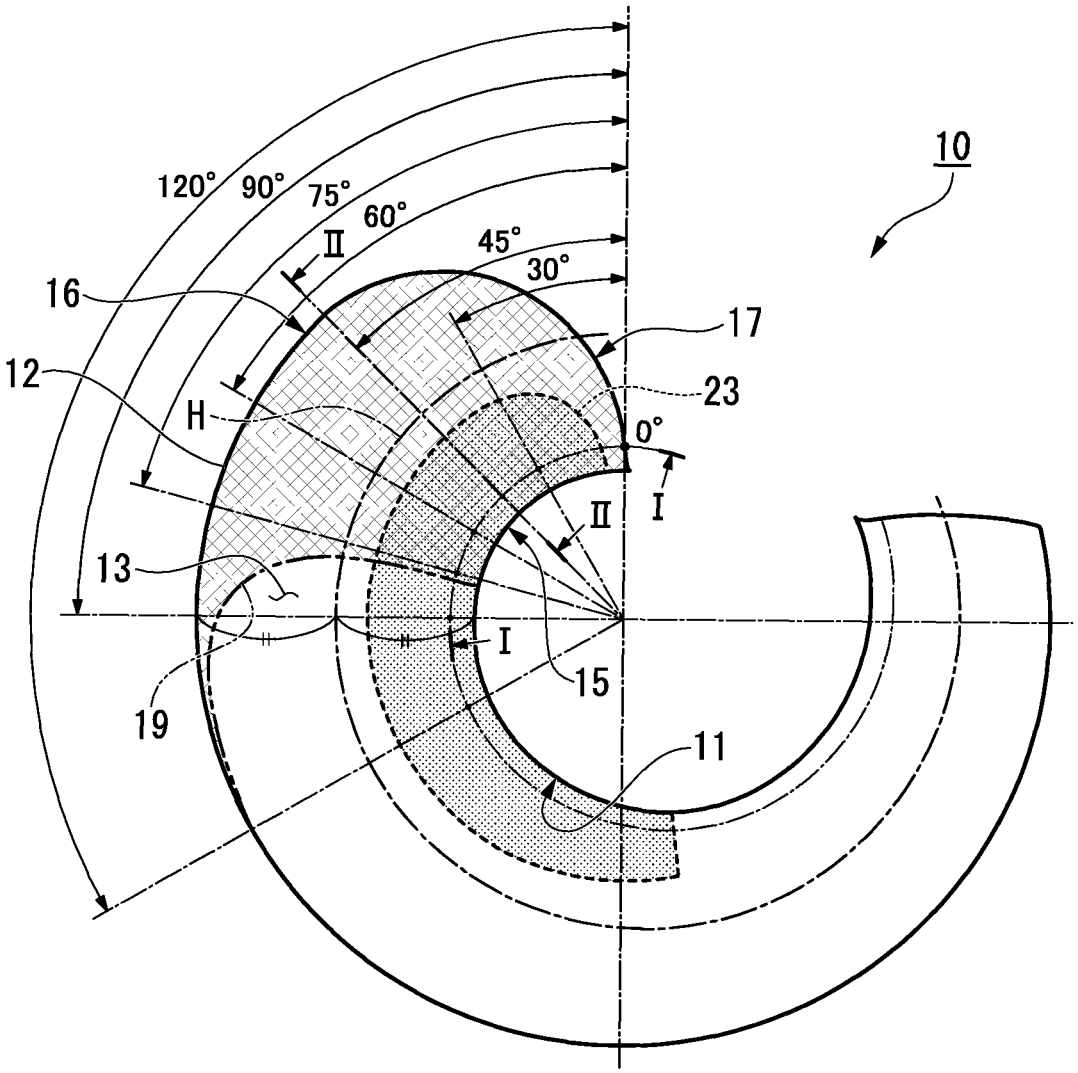
FIG. 3 is a view when a blade in the embodiment of the present disclosure is viewed from a positive-pressure surface side.
Figure 4:
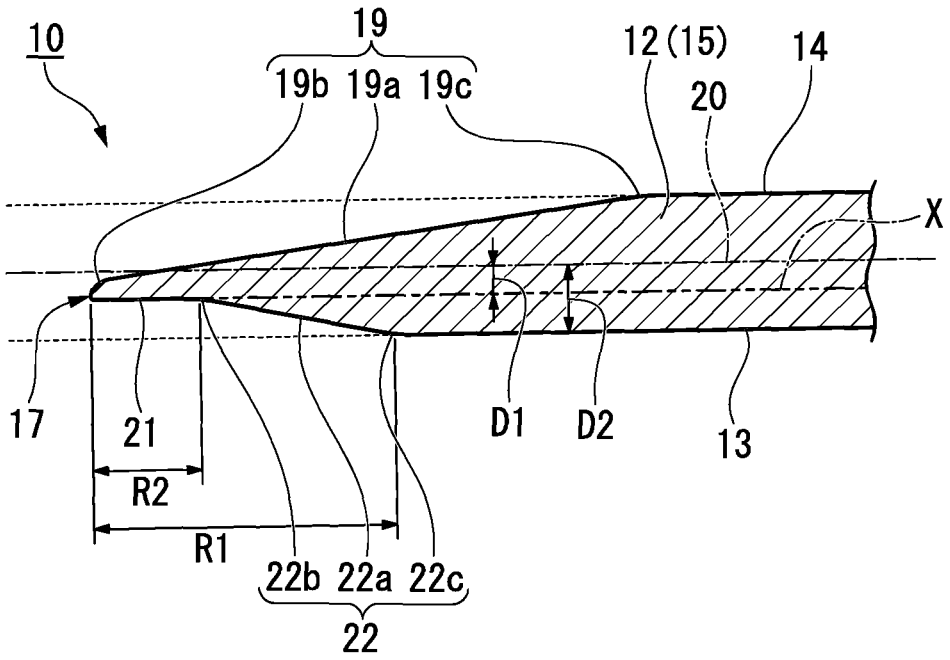
FIG. 4 is a sectional view taken along line I-I of FIG. 3.
Figure 5:
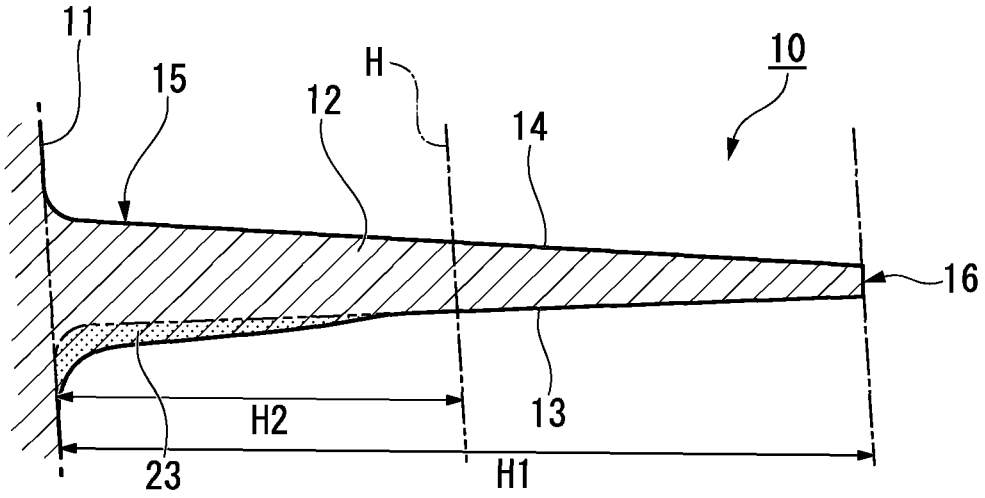
FIG. 5 is a sectional view taken along line II-II of FIG. 3.

FIG. 2 is a perspective view of the inducer 10 in the embodiment of the present disclosure. FIG. 3 is a view when the blade 12 in the embodiment of the present disclosure is viewed from a positive-pressure surface 13 side. FIG. 4 is a sectional view taken along line I-I of FIG. 3. FIG. 5 is a sectional view taken along line II-II of FIG. 3. In addition, the cross section taken along line I-I is a cross section in a rotation direction along a root portion 15 of the blade 12. Moreover, the cross section taken along line II-II is a cross section in a radial direction from the root portion 15 of the blade 12 to a tip portion 16.

As shown in FIG. 2, the inducer 10 includes the hub 11 which is formed in an approximately columnar shape and the blade 12 which radially protrudes from the hub 11 and is helically provided.

In the inducer 10, a plurality of (three in the embodiment) blades 12 are provided. The plurality of blades 12 are integrally formed with the hub 11 and are disposed in a circumferential direction (rotation direction) of the hub 11. The plurality of blades 12 have the same dimensions and the same shapes as each other. In addition, the plurality of blades 12 are disposed at equally spaced intervals in the circumferential direction of the hub 11. Moreover, the number of the blades 12 of the inducer 10 is not limited to three, and for example, may be set to an appropriate number such as four according to a kind of the pump 1 or the like.

The blade 12 includes the root portion 15 which is connected to the hub 11 and the tip portion 16 which is positioned on a side (the outside in the radial direction of the hub 11) opposite to the root portion 15. In addition, the blade 12 includes a leading edge 17 which is an upstream end and a trailing edge 18 which is a downstream end. In addition, the radial direction is a direction from the root portion 15 toward the tip portion 16. A wedge surface 19 which is inclined toward the leading edge 17 is provided in the blade 12.

As shown in FIG. 4, the wedge surface 19 is provided on the negative-pressure surface 14 side of the blade 12. The wedge surface 19 is inclined at a predetermined angle with respect to a camber line 20 which connects intermediate points between the negative-pressure surface 14 and the positive-pressure surface 13 of the blade 12 to each other. The wedge surface 19 includes an inclined flat surface 19*a*, an R surface 19*b* (curved surface) which connects a front edge side of the flat surface 19*a* and the leading edge 17 to each other, and an R surface 19*c* which a rear edge side of the flat surface 19*a* and the negative-pressure surface 14 to each other.

On the other hand, a parallel surface 21 which extends to be parallel to the camber line 20 from the leading edge 17 and an inclination surface 22 which connects the parallel surface 21 and the positive-pressure surface 13 to each other are provided on the positive-pressure surface 13 side of the blade 12. The inclination surface 22 includes a flat surface 22*a* which is inclined at a predetermined angle, an R surface 22*b* which connects a front edge side of the flat surface 22*a* and the parallel surface 21 to each other, and a R surface 22*c* which connects a rear edge side of the flat surface 22*a* and the positive-pressure surface 13 to each other. In addition, a minute R surface is provided between the parallel surface 21 and the leading edge 17.

As shown in FIG. 3, the wedge surface 19 is provided in a range from 0° to 120° at a winding angle (an angle from the leading edge 17 to the trailing edge 18) of the blade 12. As shown in FIG. 4, the parallel surface 21 and the inclination surface 22 are provided in the range, within which the wedge surface 19 is provided, on the side (the positive-pressure surface 13 side) opposite to the wedge surface 19. For example, preferably, a range R1 within which the parallel surface 21 and the inclination surface 22 are provided is a range from 0° to 15° or a range from 0° to 90° at the winding angle of the blade 12. In addition, preferably, a range R2 within the parallel surface 21 is provided is a range from 0° to 30° at the winding angle of the blade 12.

As shown FIG. 4, the root portion 15 of the blade 12 has a shape in which a first distance D1 between the camber line 20 and the leading edge 17 is shorter than a second distance D2 between the camber line 20 and the positive-pressure surface 13 of the blade 12 in the thickness direction of the blade 12. A reference numeral X shown in FIG. 4 shows an outline of the blade 12 before the blade thickness increases. In the blade 12 of the present embodiment, the blade thickness is increased by changing the shape on the positive-pressure surface 13 side without changing the shape (particularly, the angle of the wedge surface 19) on the negative-pressure surface 14 side.

As shown in FIGS. 3 and 5, a thick portion 23 in which the first distance D1 is shorter than the second distance D2 is provided in at least the root portion 15 of the blade 12 on the positive-pressure surface 13 side of the blade 12. The thick portion 23 of the present embodiment is integrally formed with the blade 12. That is, the thick portion 23 is integrally formed with the blade 12 by cutting machining. The thick portion 23 forms at least a portion of the inclination surface 22 and the positive-pressure surface 13 shown in FIG. 4.

In addition, as shown in FIG. 5, a distance from a connection portion between the hub 11 and the root portion 15 of the blade 12 to the tip portion 16 of the blade 12 in the radial direction of the blade 12 is a height H1 of the blade.

Moreover, a distance from the connection portion between the hub 11 and the root portion 15 of the blade 12 in the radial direction of the blade 12 is defined as H2. If a ratio of the distance H2 from the connection portion between the hub 11 and the root portion 15 of the blade 12 with respect to the height H1 of the blade is referred to as a height ratio of the blade 12, a position at which the height ratio of the blade 12 is 0.5, that is, a position at which H2=½H1 is satisfied is indicated by a line by shown with a reference numeral H in each of FIGS. 3 and 5.

As shown in FIGS. 3 and 5, the thick portion 23 is positioned in a region inside the position (the line indicated by the reference numeral H in each of FIGS. 3 and 5) at which the height ratio of the blade 12 is 0.5 in the radial direction. On the other hand, the thick portion 23 is not present in a region outside the position (the line indicated by the reference numeral H in each of FIGS. 3 and 5) at which the height ratio of the blade 12 is 0.5 in the radial direction, and the first distance D1 and the second distance D2 coincide with each other in the region outside the position. That is, in the region outside the position at which the height ratio of the blade 12 is 0.5, the blade 12 has an outline indicate by a reference numeral X in FIG. 4.

Then, a function of the inducer 10 configured as described above will be described with reference to FIGS. 6 to 13.

Figure 6:
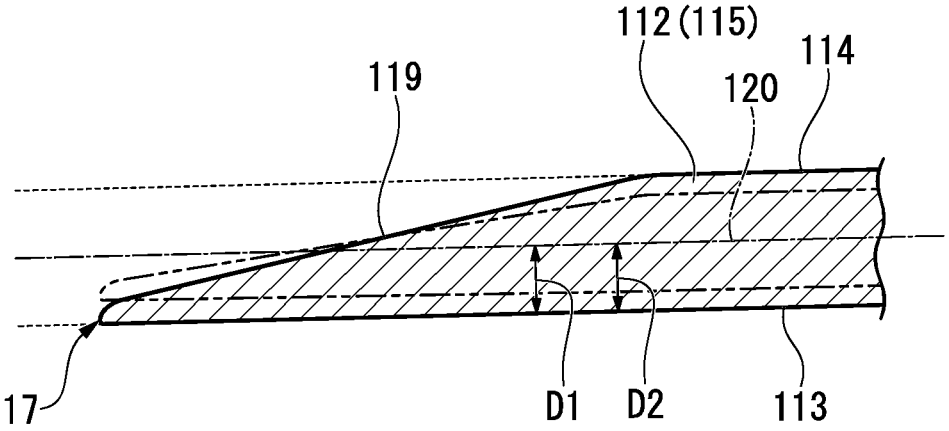
FIG. 6 is a sectional view showing a comparative example and a blade having a blade thickness increased by a method of the related art.

FIG. 6 is a sectional view showing a comparative example and a blade 112 having a blade thickness increased by a method of the related art.

In the blade 112 of the comparative example, the blade thickness is increased by changing the shape on a negative-pressure surface 114 side on which a wedge surface 119 is provided. That is, the first distance D1 between a camber line 120 which connects intermediate points between the negative-pressure surface 114 of the blade 112 and the positive-pressure surface 113 to each other and a leading edge 117 coincides with the second distance D2 between the camber line 120 and the positive-pressure surface 113 of the blade 112 in the thickness direction of the blade 112. In the method of the related art, if the blade thickness increases, the angle of the wedge surface 119 increases according to this.

Figure 7:
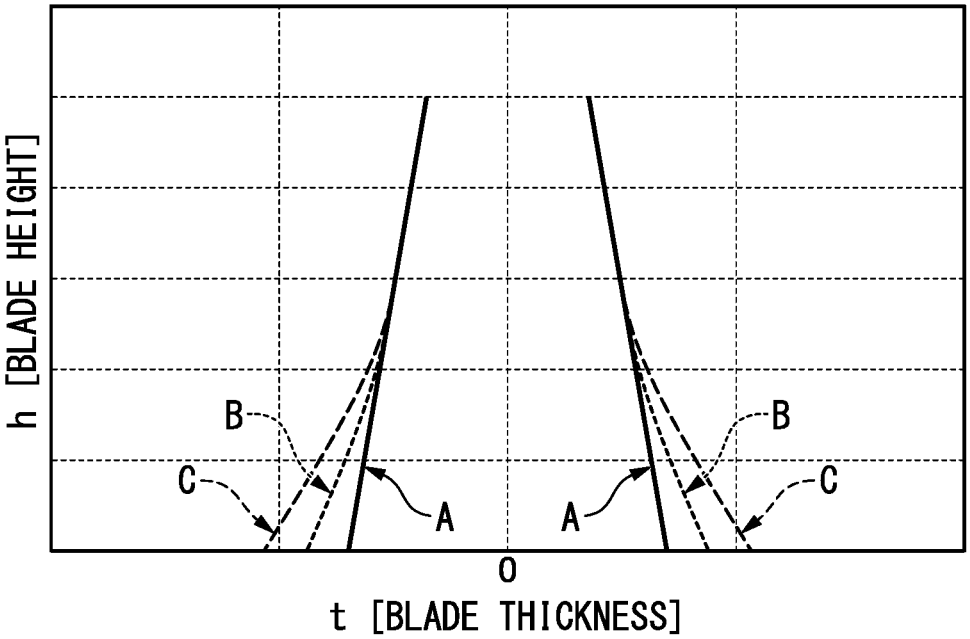
FIG. 7 is a graph showing shapes when blade thicknesses of the root portions of the blades in the comparative example are increased like A, B, and C.
Figure 8:
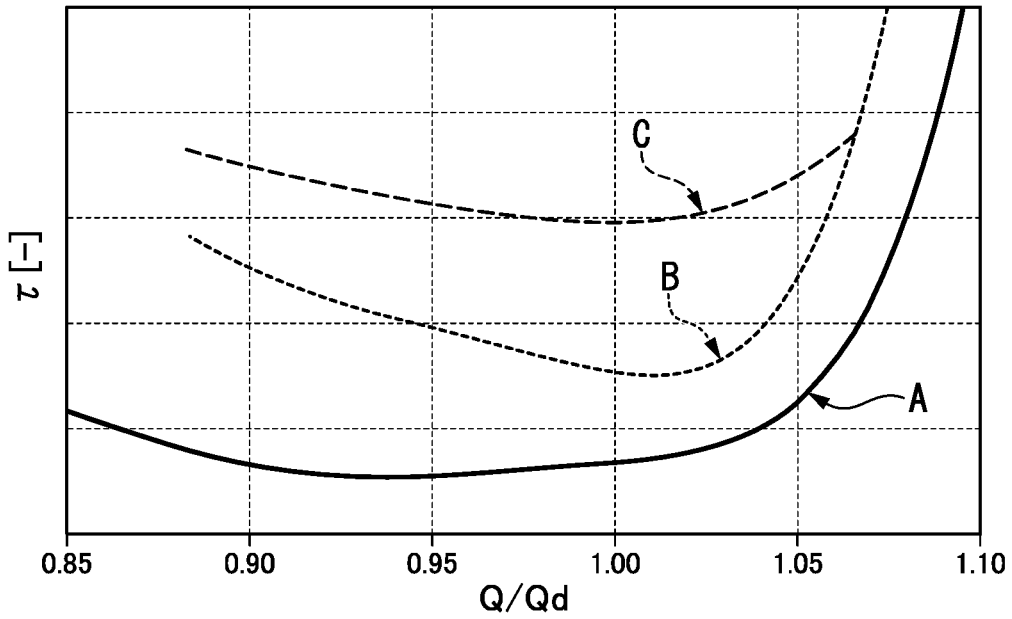
FIG. 8 is a graph showing cavitation performance of the blade in the comparative example.

FIG. 7 is a graph showing shapes when blade thicknesses of a root portion 115 of the blade 112 in the comparative example are increased like A, B, and C. In FIG. 7, h indicates a blade height and t indicates a blade thickness. Moreover, t=0 indicates the camber line 120. FIG. 8 is a graph showing cavitation performance of the blade 112 in the comparative example. In FIG. 8, τ indicates the cavitation performance and Q/Qd indicates a flow rate ratio of the pump. Qd is a design flow rate of a test pump and Q is an actual flow rate during the operation of the pump.

It is understood that as shown in FIG. 8, for example, if comparison is performed at Q/Qd=1.0 in which the design flow rate and the actual flow rate coincide with each other, in the case where the blade thickness increases like A, B, and C using the method of the related art, it is understood that the cavitation performance deteriorates (the cavitation easily occurs) as the blade thickness increases.

Figure 9:
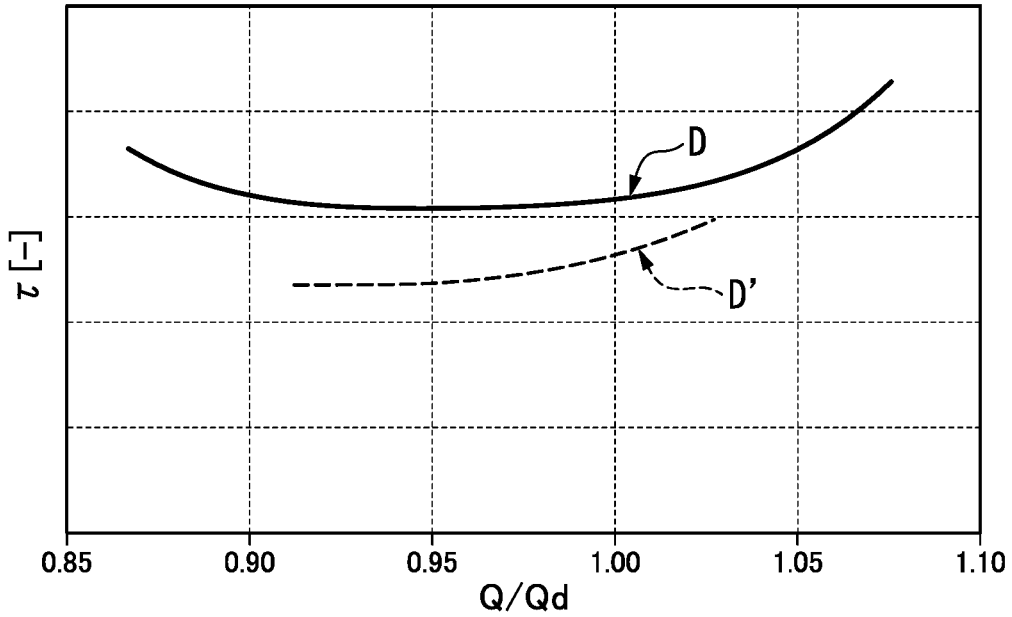
FIG. 9 is a graph showing cavitation performance of the blade in the embodiment of the present disclosure.

FIG. 9 is a graph showing cavitation performance of the blade 12 in the embodiment of the present disclosure. FIG. 9 shows the performance of the cavitation when the blade thickness of the root portion 15 of the blade 12 is changed from D (the outline of the blade 12 indicated by the reference numeral X in FIG. 4) to D' (the outline of the blade 12 indicated by the solid line in FIG. 4).

It is understood that as shown in FIG. 9, for example, if comparison is performed at Q/Qd=1.0 in which the design flow rate and the actual flow rate coincide with each other, in the case where the blade thickness increases from D to D' using the method of the present disclosure, it is understood that the cavitation performance is improved (cavitation does not easily occur) as the blade thickness increases. Moreover, it is understood that as shown in FIG. 4, the root portion 15 of the blade 12 is thickened by changing the shape on the positive-pressure surface 13 side of the blade 12 without changing the shape (the angle of the wedge surface 19) on the negative-pressure surface 14 side of the blade 12 on which the wedge surface 19 is provided, and thus, the cavitation performance can be improved.

Figure 10:
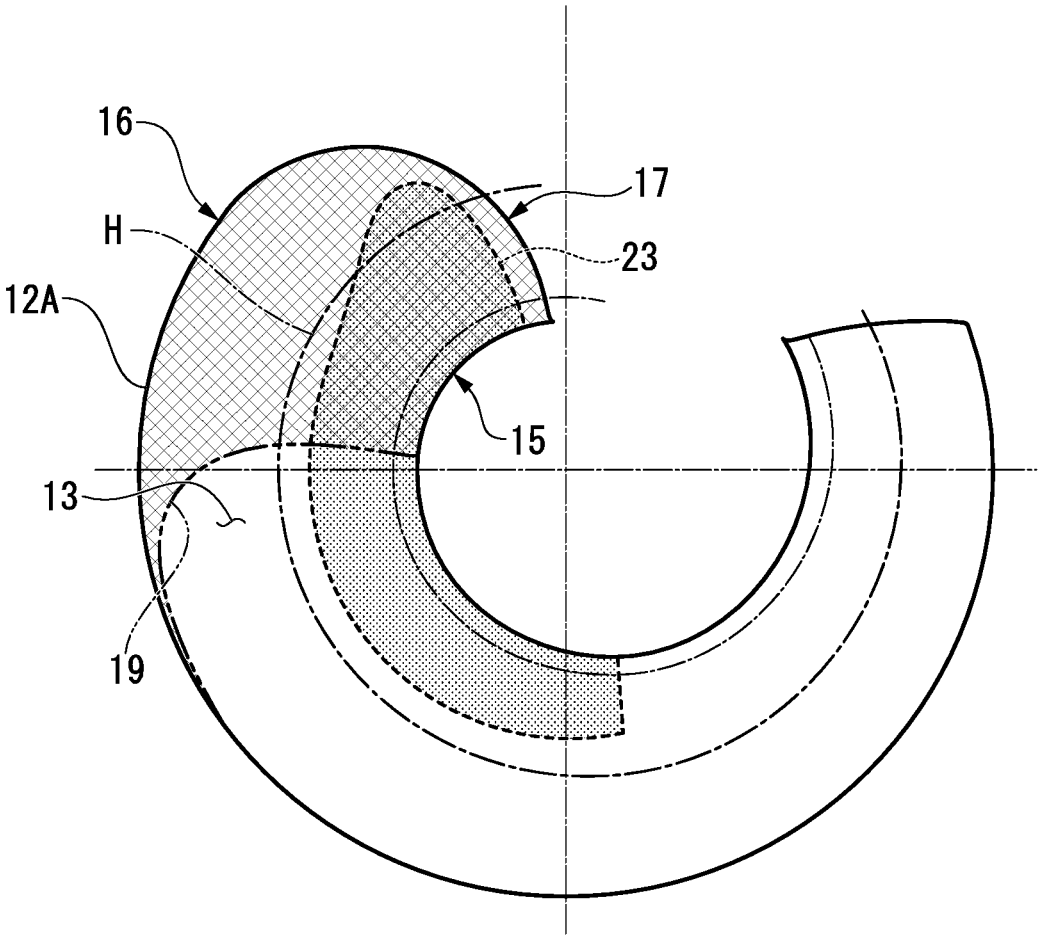
FIG. 10 is a view when a blade in another embodiment of the present disclosure is viewed from a positive-pressure surface side.
Figure 11:
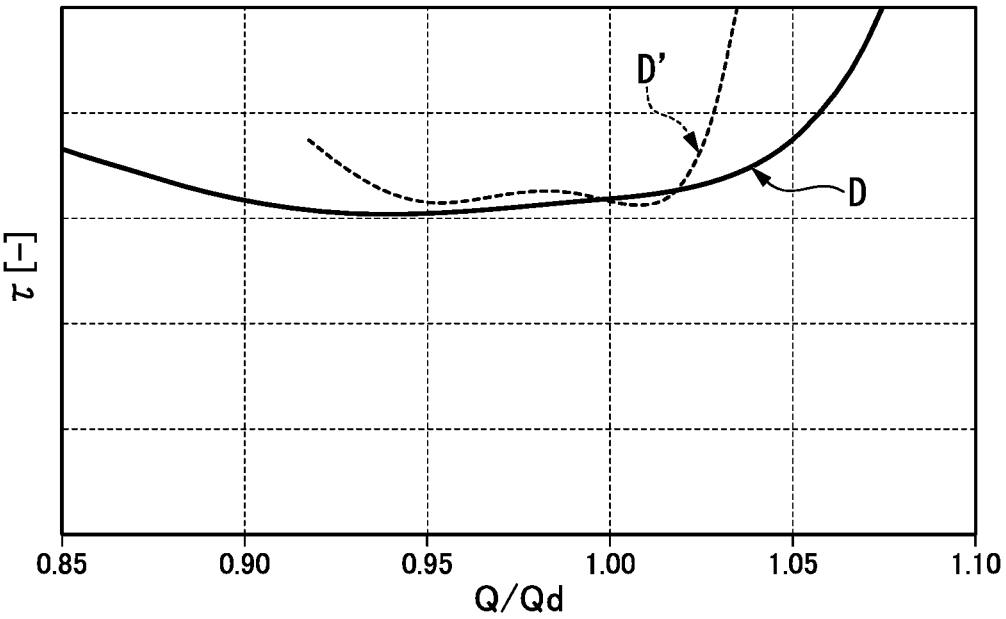
FIG. 11 is a graph showing cavitation performance of the blade in another embodiment of the present disclosure.

FIG. 10 is a view when a blade 12A in another embodiment of the present disclosure is viewed from the positive-pressure surface 13 side. FIG. 11 is a graph showing the cavitation performance of the blade 12A in another embodiment of the present disclosure. FIG. 11 shows the performance of the cavitation when the blade thickness of the root portion 15 of the blade 12A is changed from D to D'.

As shown in FIG. 10, the blade 12A of another embodiment is different from that of the above-described embodiment in that a portion of the thick portion 23 protrudes to the region outside the position at which the height ratio of the blade 12 is 0.5 in the radial direction. However, other configurations are similar to those of the above-described embodiment.

As shown in FIG. 11, for example, in the blade 12A of another embodiment, if comparison is performed at Q/Qd=1.0 at which the design flow rate and the actual flow rate coincide with each other, the same cavitation performance is provided before and after the blade thickness increases. That is, it is understood that if FIGS. 9 and 11 are compared with each other, in order to increase the cavitation performance, it is understood that the thick portion 23 being positioned in the region inside the position at which the height ratio of the blade 12 is 0.5 is preferable.

Figure 12:
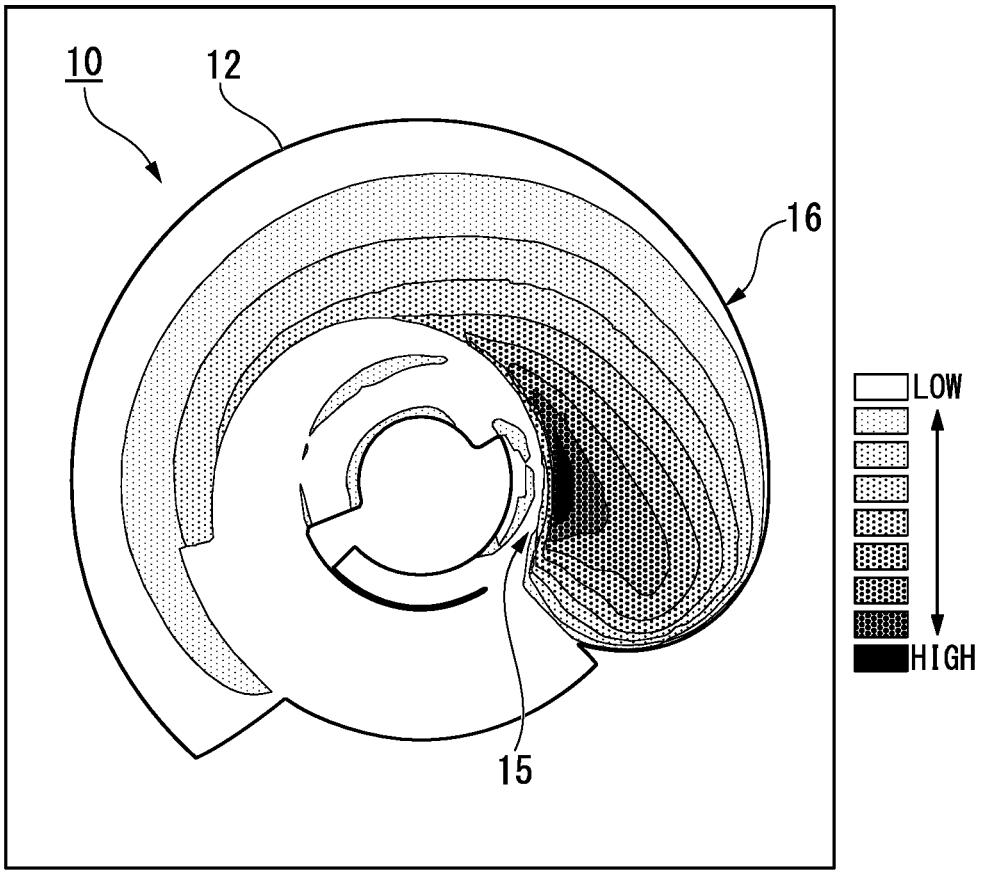
FIG. 12 is a view showing a stress distribution on a blade surface of the inducer in the embodiment of the present disclosure.
Figure 13:
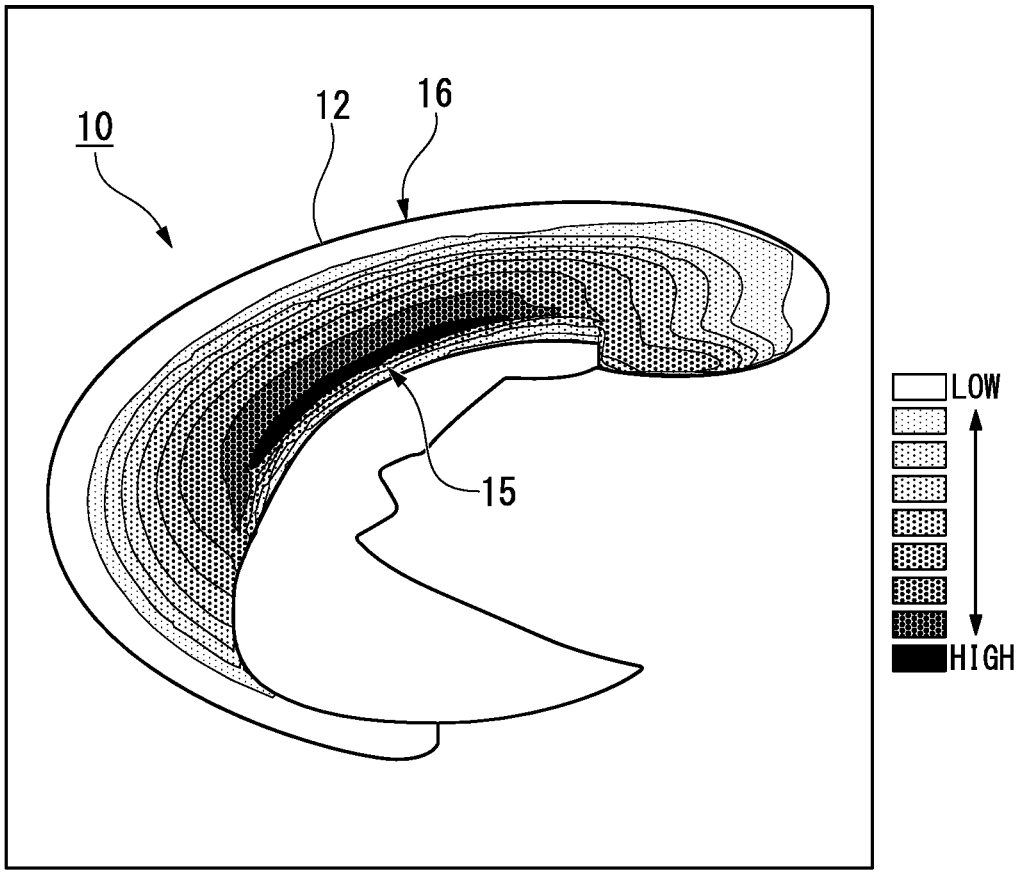
FIG. 13 is a view showing the stress distribution of the blade surface of the inducer in the embodiment of the present disclosure when viewed from an angle different from that of FIG. 12.

FIG. 12 is a view showing a stress distribution on the blade surface of the inducer in the embodiment of the present disclosure. FIG. 13 is a view showing the stress distribution of the blade surface of the inducer in the embodiment of the present disclosure when viewed from an angle different from that of FIG. 12.

It is understood that as shown in FIGS. 12 and 13, in the stress distribution on the blade surface of the inducer, it is understood that the stress in the root portion 15 of the blade 12 is high.

In the present embodiment, it is understood that the blade thickness is thickened at least in the root portion 15 of the blade 12 and bending strength of the blade 12 is effectively improved.

In this way, according to the above-described embodiment, the wedge surface 19 which is inclined toward the leading edge 17 is provided on the negative-pressure surface 14 side of the blade 12 of the inducer 10 having the hub 11 and the blade 12 which radially protrudes from the hub 11 and is helically provided. Moreover, the inducer has the thick portion 23 in which the first distance D1 and the second distance D2 coincide with each other in the region outside a position at which the height ratio of the blade 12 is 0.5 while the first distance D1 is shorter than the second distance D2 in the region inside the position at which the height ratio of the blade 12 is 0.5, in which the height ratio is the ratio of the distance H2 from the connection portion between the hub 11 and the root portion 15 of the blade 12 with respect to the height H1 of the blade which is the distance from the connection portion between the hub 11 and the root portion 15 of the blade 12 to the tip portion 16 of the blade 12 in the radial direction of the blade 12. Accordingly, it is possible to obtain the inducer 10 and the pump 1 capable of increasing the bending strength of the blade 12 by increasing the blade thickness in the root portion 15 of the blade 12 in a state where the cavitation performance is maintained.

Hereinbefore, the preferred embodiment of the present disclosure is described with reference to the drawings. However, the present disclosure is not limited to the embodiment. The shapes, the combinations, or the like of the components shown in the above-described embodiment are examples, and various modifications can be applied the present disclosure based on design requirements or the like within a scope which does not depart from the gist of the present disclosure.

For example, in the embodiment, the configuration in which the thick portion 23 is integrally formed with the blade 12 is described. The present disclosure is not limited to the configuration, and the thick portion 23 may be formed of an addition separated from the blade 12.

For example, as the addition, the root portion 15 of the blade 12 of the inducer 10 may be thermal-sprayed to increase the thickness, and the thick portion 23 may be formed of the addition.

In addition, for example, as the addition, a brazing material sheet may be attached to the root portion 15 of the blade 12 of the inducer 10 to melt the brazing material sheet so as to increase the thickness, and the thick portion 23 may be formed of the addition.

For example, in the embodiment, the configuration is described in which the parallel surface 21 which extends to be parallel to the camber line 20 from the leading edge 17 and the inclination surface 22 which connects the parallel surface 21 and the positive-pressure surface 13 to each other are provided on the positive-pressure surface 13 side of the root portion 15. However, the present disclosure is not limited to this, and for example, the parallel surface 21 may not be provided and only the inclination surface may be provided between the leading edge 17 and the positive-pressure surface 13.

INDUSTRIAL APPLICABILITY

According to the present disclosure, it is possible to obtain the inducer and the pump capable of increasing the bending strength of the blade by increasing the blade thickness in the root portion of the blade in the state where the cavitation performance is maintained.

The invention claimed is:

1. An inducer comprising:

a hub;

a blade which radially protrudes from the hub and is helically provided; and a wedge surface which is provided on a negative-pressure surface of the blade so as to be inclined with respect to a camber line connecting intermediate points between the negative-pressure surface and a positive-pressure surface of the blade and toward a leading edge, the negative-pressure surface of the blade being a surface facing an upstream of a fluid of which a pressure is increased by the inducer, wherein a first distance between the camber line and the leading edge coincides with a second distance between the camber line and the positive-pressure surface of the blade in a region radially outward from a position at which a height ratio of the blade is 0.5, wherein the height ratio of the blade is a ratio of a distance from a connection portion between the hub and a root portion of the blade with respect to a height of the blade which is a distance from the connection portion between the hub and the root portion of the blade to a tip portion of the blade in the radial direction of the blade, and wherein the inducer comprises a thick portion, in which the first distance is less than the second distance, on the positive-pressure surface of the blade in a region radially inward from the position at which the height ratio of the blade is 0.5.

2. The inducer according to claim 1, wherein the thick portion is integrally formed with the blade.

3. The inducer according to claim 1, wherein the thick portion is formed of an addition separated from the blade.

4. The inducer according to claim 1, wherein a parallel surface which extends from the leading edge to be parallel to the camber line and an inclination surface which connects the parallel surface and the positive-pressure surface to each other are provided on at least a positive-pressure surface side of the root portion.

5. The inducer according to claim 2, wherein a parallel surface which extends from the leading edge to be parallel to the camber line and an inclination surface which connects the parallel surface and the positive-pressure surface to each other are provided on at least a positive-pressure surface side of the root portion.

6. The inducer according to claim 3, wherein a parallel surface which extends from the leading edge to be parallel to the camber line and an inclination surface which connects the parallel surface and the positive-pressure surface to each other are provided on at least a positive-pressure surface side of the root portion.

7. A pump comprising the inducer according to claim 1.

8. A pump comprising the inducer according to claim 2.

9. A pump comprising the inducer according to claim 3.

10. A pump comprising the inducer according to claim 4.

11. A pump comprising the inducer according to claim 5.

12. A pump comprising the inducer according to claim 6.

* * * * *